United States Patent [19]

Chimentin

[11] 4,277,924

[45] Jul. 14, 1981

[54] PREFABRICATED BURIAL CHAMBER

[76] Inventor: Ermenegildo Chimentin, Via Cesare Battisti 54, Lessolo, Torino, Italy

[21] Appl. No.: 28,746

[22] Filed: Apr. 10, 1979

[30] Foreign Application Priority Data

Apr. 12, 1978 [IT] Italy ..... 53173/78[U]

[51] Int. Cl.[3] ..... E04H 13/00

[52] U.S. Cl. ..... 52/136

[58] Field of Search ..... 52/136–142, 52/79.2, 79.14, 236.8

[56] References Cited

U.S. PATENT DOCUMENTS

| | | | |
|---|---|---|---|
| 2,913,895 | 11/1959 | Blasius et al. | 52/137 |
| 3,287,865 | 11/1966 | Lockman | 52/79.14 |
| 3,510,997 | 5/1970 | Ratych | 52/79.14 |
| 3,722,834 | 11/1973 | Barraud | 52/79.2 |
| 3,835,601 | 9/1974 | Kelbish | 52/79.2 |

FOREIGN PATENT DOCUMENTS

| | | | |
|---|---|---|---|
| 640649 | 11/1963 | Belgium | 52/79.2 |
| 50745 | 5/1956 | German Democratic Rep. | 52/79.2 |

*Primary Examiner*—James L. Ridgill, Jr.

*Attorney, Agent, or Firm*—Schwartz, Jeffery, Schwaab, Mack, Blumenthal & Koch

[57] ABSTRACT

A prefabricated burial chamber adapted to be mounted on or adjacent similar burial chambers and cast integrally of reinforced concrete with a pair of side walls, a rear and a top wall and a vertical pillar connected to a front edge of one of said side walls.

1 Claim, 4 Drawing Figures

PREFABRICATED BURIAL CHAMBER

BACKGROUND OF THE INVENTION

This invention relates to a prefabricated burial chamber adapted to be placed adjacent or above other similar chambers to form a multicellular burial building on cemeteries.

For the construction of burial buildings prefabricated units formed integrally of reinforced concrete are known. Each of these units comprises a pair of side walls and an upper wall of the same thickness and a bottom wall. Such units are designed to be placed adjacent and/or above other similar units to form a multicellular burial building.

With this type of prefabricated burial chambers there is the drawback that the junction lines between adjacent chambers are visible on the front side of the building and have to be sealed and covered with a finishing coating to give them an acceptable aspect. This involves additional expenditure for materials and manpower. Other drawbacks and difficulties are encountered in horizontally and vertically aligning adjacent burial chambers.

SUMMARY OF THE INVENTION

It is an object of the present invention to provide an improved prefabricated burial chamber for multicellular burial buildings, which can be prefabricated in a great number of identical burial chamber units adapted to be set up in situ to form a multistorey building without requiring practically any additional finishing operations and nevertheless affording an excellent aesthetical appearance and ensuring perfect sealing of the junction lines.

This and other objects and advantages which will become apparent in the course of the following description, are achieved according to the invention by providing a prefabricated burial chamber which comprises a structure cast integrally of reinforced concrete with a pair of side walls of a given thickness, connected by a rear wall of the same thickness and an upper wall of double thickness, and with a vertical pillar of at least double thickness, connected to a front edge of one of said side walls.

DESCRIPTION OF PREFERRED EMBODIMENT

Figure 3:
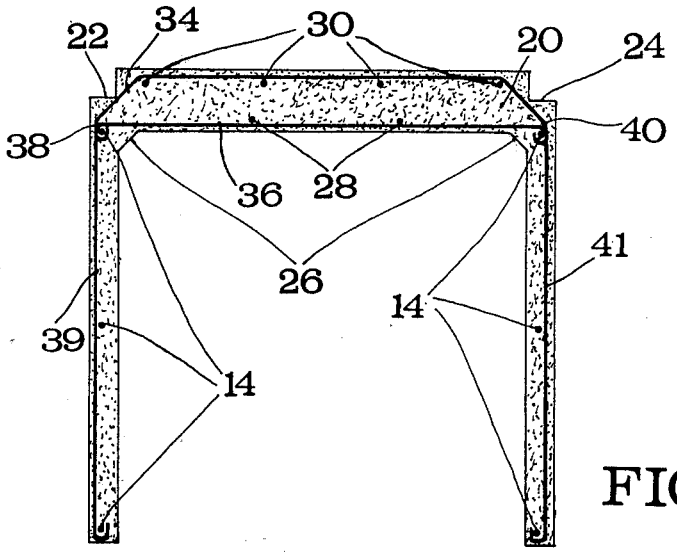
FIG. 3 is a transverse section taken along the line III—III in FIG. 2.
Figure 1:
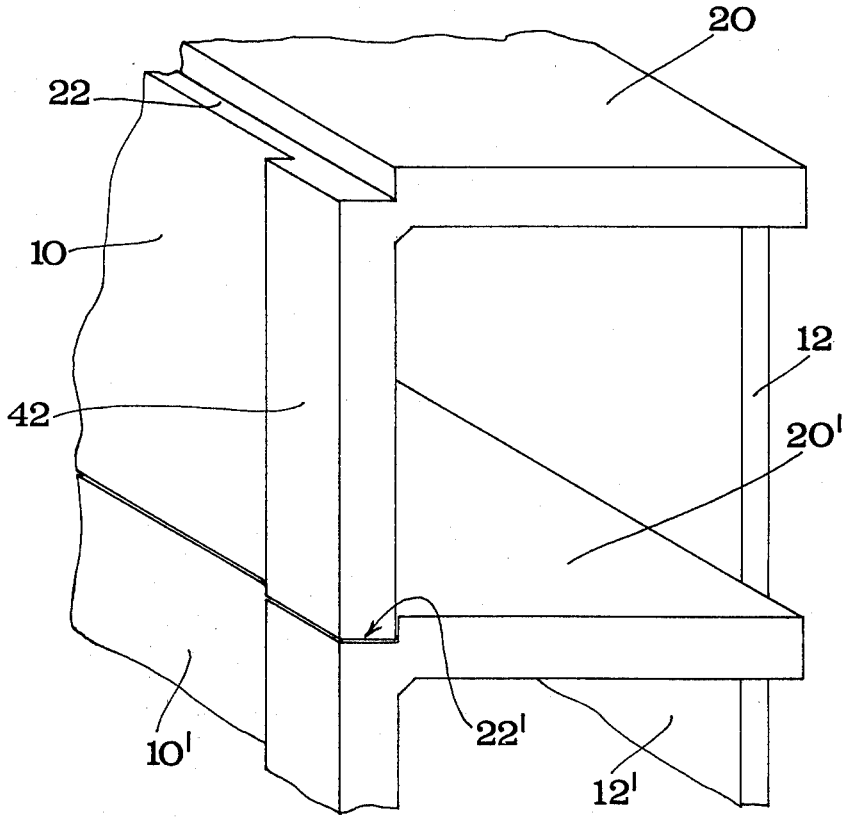
FIG. 1 is a broken-away perspective view of a pair of prefabricated burial chambers according to the invention, these chambers being arranged one above the other.
Figure 4:
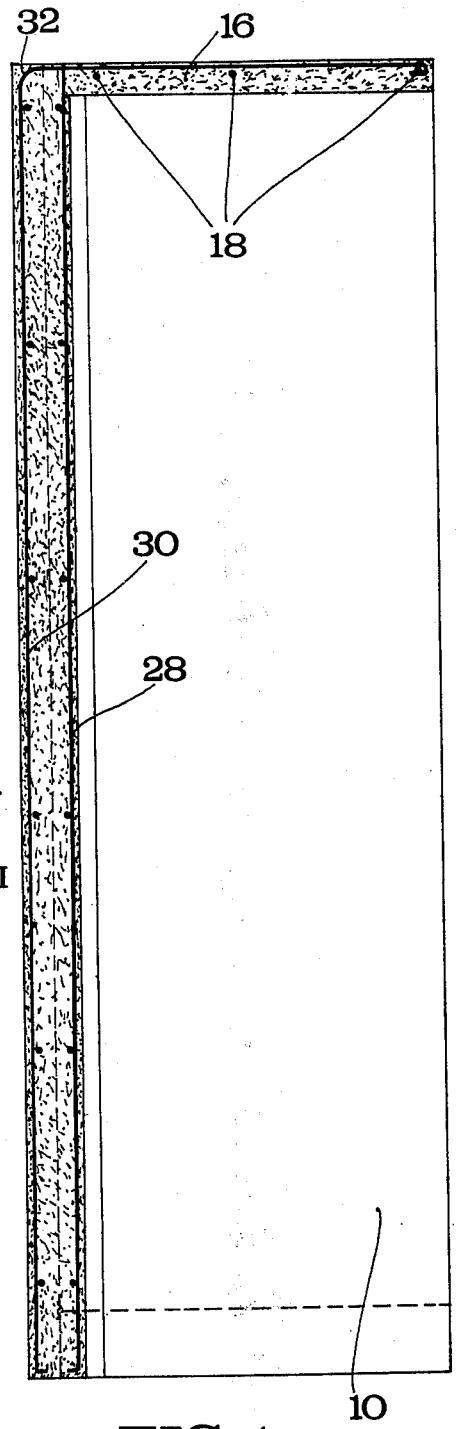
FIG. 4 is a longitudinal section taken along the line IV—IV in FIG. 2.

As shown in the drawings, particularly FIG. 1, a prefabricated burial chamber according to the preferred embodiment of the invention comprises a pair of side walls 10 and 12, or 10' and 12' in the lower chamber shown in FIG. 1, of a given relatively small thickness such as 5 cm, made of reinforced concrete with longitudinal reinforcing rods as 14 (FIG. 3) and a rear wall 16 (FIG. 2) cast integrally with the side walls 10 and 12 and likewise having preferably a thickness of 5 cm, the rear wall 16 being provided with horizontal reinforcing rods such as 18 (FIG. 4).

As shown in FIG. 3, the prefabricated burial chamber further comprises an upper wall or roof 20, or 20' in the lower chamber in FIG. 1, likewise cast of reinforced concrete integrally with the walls 10, 12 and 16, but with a thickness about twice that of the latter walls, i.e. preferably 10 cm, with a pair of lateral abutment edges or steps 22 and 24, or 22' in the lower chamber in FIG. 1, extending longitudinally over the entire length of the chamber and having a width corresponding to that of the side walls 10 and 12, i.e. of 5 cm in the present case, and a height of a few centimeters, e.g. again 5 cm.

The inner connecting edges between the upper wall 20 and side walls 10, 12 are preferably beveled as indicated at 26 in FIG. 3. Further, the upper wall or roof 20 is provided with longitudinal reinforcing rods such as 28, which extend horizontally over the entire length of the chamber, and horizontal longitudinal reinforcing rods 30 bent substantially perpendicularly at 32 (FIG. 4) to extend downwardly along the rear wall 16 as a reinforcement for the latter. Moreover, as shown in FIG. 3, the upper wall 20 is provided with upper transverse reinforcing rods 34 and lower transverse reinforcing rods 36 which are bent perpendicularly at 38 and 40, respectively, to form portions 39 and 41, respectively, extending downwardly along the side walls 10 and 12 forming a sort of gateway.

Figure 2:
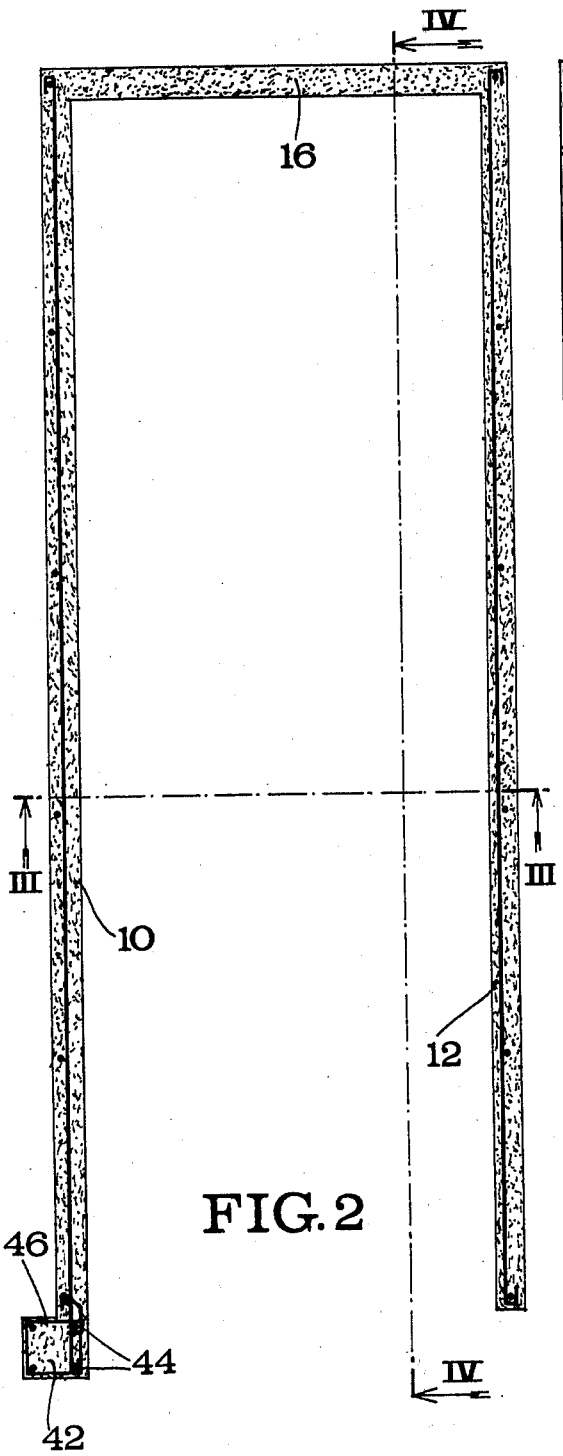
FIG. 2 is a horizontal section through a prefabricated burial chamber as shown in FIG. 1.

As shown in FIGS. 1 and 2, one of the side walls, for example, the side wall 10, has at its front end a thickened portion 42 in the form of a pillar or column which projects beyond the front end of the opposite side wall 12 by a length of, for example, about 10 cm and a width slightly greater than double the thickness of one of the side walls 10 or 12, in the present case, for example, by 11 cm. The inner side of the pillar 42 is flush with the inner surface of the side wall 10 whereas on the opposite side the pillar 42 projects from the outer surface of side wall 10 by a distance corresponding obviously to the difference between the thickness of the pillar and that of the side wall, in the present case by about 6 cm. The roof 20 projects beyond side wall 12 to terminate flush with the front side of pillar 42. As seen in FIG. 2, the pillar 42 is also provided with four vertical reinforcing rods 44 and a plurality of looped horizontal reinforcing rods 46 hooked onto the adjacent vertical reinforcing rods in the side wall 10.

ADVANCE OVER THE PRIOR ART

The prefabricated burial chamber thus formed and to be made according to processes known in the art is particularly efficient and convenient to use because, as will be evident from the drawings, it can be easily connected to similar adjacent burial chambers with or without pillar, placed with their side walls alongside, with the junction between the two adjacent walls being filled by a sealing paste and covered by the pillar which thus affords a sturdy and aesthetically perfect finish.

Also the arrangement of several burial chambers one above another for the construction of a multistoried burial building is facilitated by the abutment edges or steps 22, 24 which accurately position the lower edges of the side and rear walls of the upper burial chamber.

Although a preferred embodiment of the invention has thus been described in detail and illustrated in the accompanying drawings it is to be understood that the invention is not limited to this precise embodiment and that numerous changes and modifications obvious to one skilled in the art may be made therein without departing from the scope of the invention as defined by the appended claims.

I claim:

1. A prefabricated burial chamber in the form of a structure cast integrally of reinforced concrete comprising first and second side walls of a given thickness, said side walls being interconnected to a rear wall of the same thickness and an upper wall of double thickness; an abutment step extending along each of the longitudinal edges of said upper wall and having a width corresponding to said given thickness of said first and second side walls; and a vertical pillar formed on a front edge of said first side wall, said vertical pillar having at least twice the thickness of said side walls and a width greater than said thickness, said width being defined by a front and a rear edge, said front edge of said first side wall being flush with the front edge of said upper wall, and said rear edge of said pillar being aligned with the front edge of said second side wall, whereby superimposed or laterally adjacent structures can be quickly and easily aligned with similar structures.

* * * * *